US006851751B1

(12) United States Patent
Romero et al.

(10) Patent No.: US 6,851,751 B1
(45) Date of Patent: Feb. 8, 2005

(54) WHEELCHAIR SEAT LIFT APPARATUS

(76) Inventors: Clifford J. Romero, 121 Dudley St., Lafayette, LA (US) 70501-4804; Linda R. Borel, 1210 Virginia St., Lake Charles, LA (US) 70607; Joseph Clint Borel, 3664 A. Miller Rd., Lake Charles, LA (US) 70605

( * ) Notice: Subject to any disclaimer, the term of this patent is extended or adjusted under 35 U.S.C. 154(b) by 0 days.

(21) Appl. No.: 10/672,249

(22) Filed: Sep. 29, 2003

(51) Int. Cl.[7] ..... A47C 1/02

(52) U.S. Cl. ..... 297/331; 297/330; 297/DIG. 10; 280/250.1

(58) Field of Search ..... 297/330, 331, 297/DIG. 10; 280/250.1, 47.41, 304.1

(56) References Cited

U.S. PATENT DOCUMENTS 3,379,450 A * 4/1968 Emerson et al. ..... 280/657
4,390,076 A * 6/1983 Wier et al. ..... 180/11
4,455,029 A * 6/1984 Taylor ..... 280/5.28
4,802,542 A * 2/1989 Houston et al. ..... 180/65.5
4,809,804 A * 3/1989 Houston et al. ..... 180/65.5
5,108,202 A * 4/1992 Smith ..... 297/330
5,265,689 A * 11/1993 Kauffmann ..... 180/65.5
5,346,280 A * 9/1994 Deumite ..... 297/330
5,356,172 A * 10/1994 Levy et al. ..... 280/650
5,556,121 A * 9/1996 Pillot ..... 280/304.1
5,707,104 A * 1/1998 Perego ..... 297/16.1
5,984,338 A * 11/1999 Meyer ..... 280/304.1
6,142,568 A * 11/2000 Abelbeck et al. ..... 297/344.17
6,213,554 B1 * 4/2001 Marcoux et al. ..... 297/330
6,250,717 B1 * 6/2001 Porcheron ..... 297/411.3
6,425,634 B1 * 7/2002 Romero ..... 297/331
6,454,285 B1 * 9/2002 Koenig ..... 280/250.1

* cited by examiner

*Primary Examiner*—Peter M. Cuomo
*Assistant Examiner*—Erika Garrett
(74) *Attorney, Agent, or Firm*—Glenn B. Foreman

(57) ABSTRACT

An apparatus adaptable to a wheelchair, for assisting a person seated in the wheelchair to move to a standing position. The apparatus includes opposing pivoting rods as a mechanical leverage lift attached to the bottom of a hinged seat. The action of stepping on the leverage lift device either at the front or at the rear of the chair results in the seated person being lifted. The leverage device lifts the seat from a sitting position to a substantially raised flat position, so that a person sitting in the seat is likewise lifted from a seated position to a partially standing position. The lift mechanism is located at the front and the rear of the wheelchair, depending on whether the person would be assisted by one or two persons in front and/or behind the chair.

19 Claims, 4 Drawing Sheets

WHEELCHAIR SEAT LIFT APPARATUS

CROSS REFERENCES

This invention is related to application Ser. No. 09/766,371, Filed Jan. 19, 2001, now U.S. Pat. No. 6,425,634 B1, granted Jul. 30, 2002.

GENERAL BACKGROUND OF THE INVENTION

The apparatus of the present invention relates to wheelchairs. More particularly, the present invention relates to an apparatus that may be adaptable to an existing wheelchair to assist in lifting a patient from the chair or returning the patient to a chair by a third party, such as a nurse or health care giver.

Because of ailments or old age, many people are unfortunately confined to wheelchairs for extended periods of time, or in the case of the elderly, for the remainder of their lives. A wheelchair is a vital vehicle in allowing people who are not ambulatory to be able to get from place to place. However, particularly in the group of the very aged, or the very weak, the task of moving from the seated position in a wheelchair to a standing position, can be a very difficult task for the person confined to the chair, or even when the person is being assisted by a third party. For example, for the people who are able to stand briefly, but are unable to walk because they are too weak, oftentimes they will have insufficient strength to lift themselves from the chair to the standing position, even to move into bed.

These types of individuals are in need of assistance in helping them to stand, or, when they return to the chair, in being seated slowly, since they are too weak to lower themselves slowly into the chair.

Therefore, there is a need for an apparatus to assist such wheelchair bound individuals in moving from and returning to the chair, without placing undue strain on the individual, or on a third party, such as a nurse or care giver, who assists the person in this task. The prior art statement accompanying this application cites prior art patents which may be pertinent in the art, but fall short of solving the problems presented.

BRIEF SUMMARY OF THE INVENTION

The apparatus of the present invention solves the problems in a simple and straightforward manner. What is provided is an apparatus, adaptable to a wheelchair, for assisting a person seated in the wheelchair to move to a standing position, the apparatus including a seat, having a portion hinged to a back portion and hinged to front upper frame support rods at bottom front, opposing lift bars, front and rear, rotated on a lower frame support rod, attached to a seat bracket below the seat and a foot member. So that when the foot member is moved to a down position, the rotating lift bars attached to the seat bracket will raise the seat from a sitting position to a substantially raised flat position, so that a person sitting in the seat is likewise lifted from a seated position to a partially standing position. The lift mechanism may be positioned at the front and the rear of the chair depending whether the person would be assisted by a third person in front of or behind the chair.

Therefore, it is a principal object of the present invention to provide a wheelchair assist apparatus which allows a third person to maneuver the seat of the chair from a sitting position to a second position, moving the person in the chair to a substantially standing position;

It is a further object of the present invention to provide a wheelchair assist apparatus which, upon a third person engaging a foot member, the seat of the chair is pushed upward to lift the person seated in the chair to a standing position;

It is a further object of the present invention to provide and apparatus to assist a person to be lifted from the chair with ease, or to return the chair without having to "fall" within the chair;

It is still a further object of the invention to provide an apparatus which is adaptable to an existing wheel chair which would allow the person in the chair to be lifted with the assistance of a third person with ease from the chair, either from the rear of or the front of the chair.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements wherein.

DETAILED DESCRIPTION OF THE INVENTION

Figure 1:
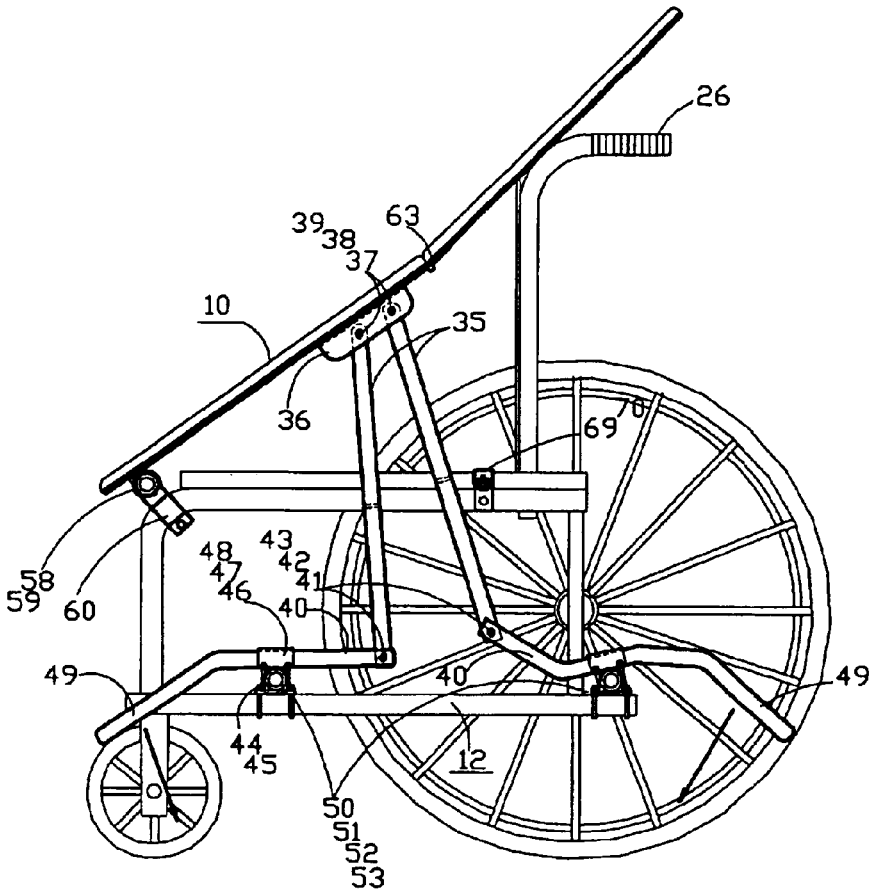
FIG. 1 is a side view of the lift mechanism in the extended position in the apparatus of the present invention.
Figure 2:
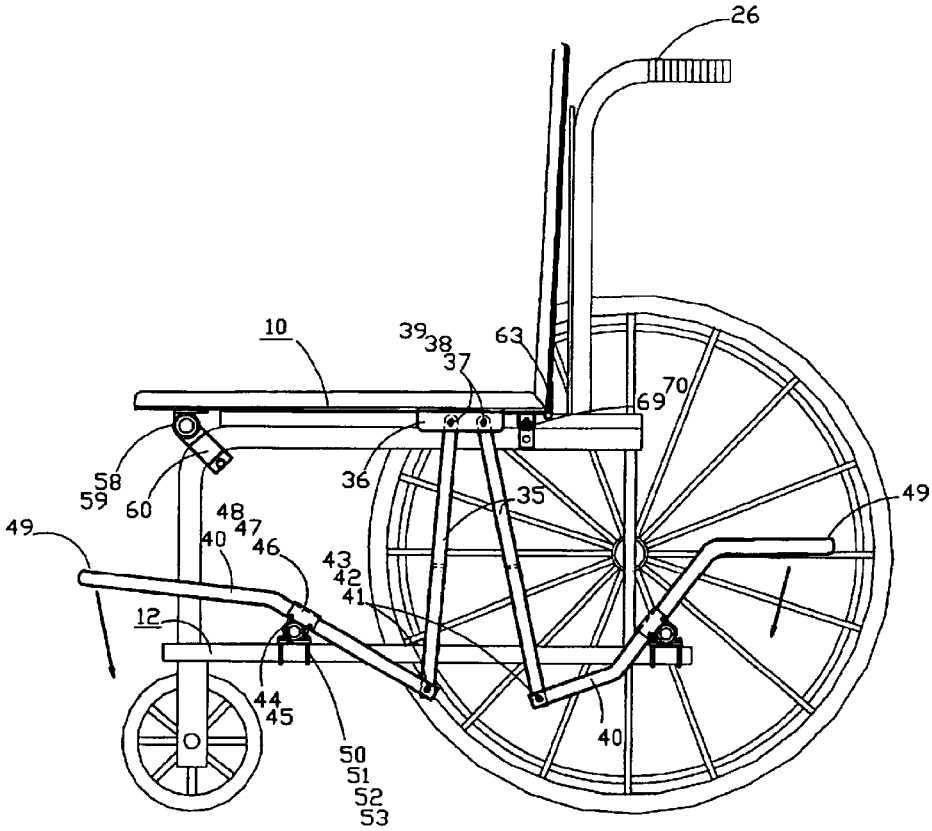
FIG. 2 is a side view of the apparatus of the present invention illustrating the seat in the sitting mode.
Figure 3:
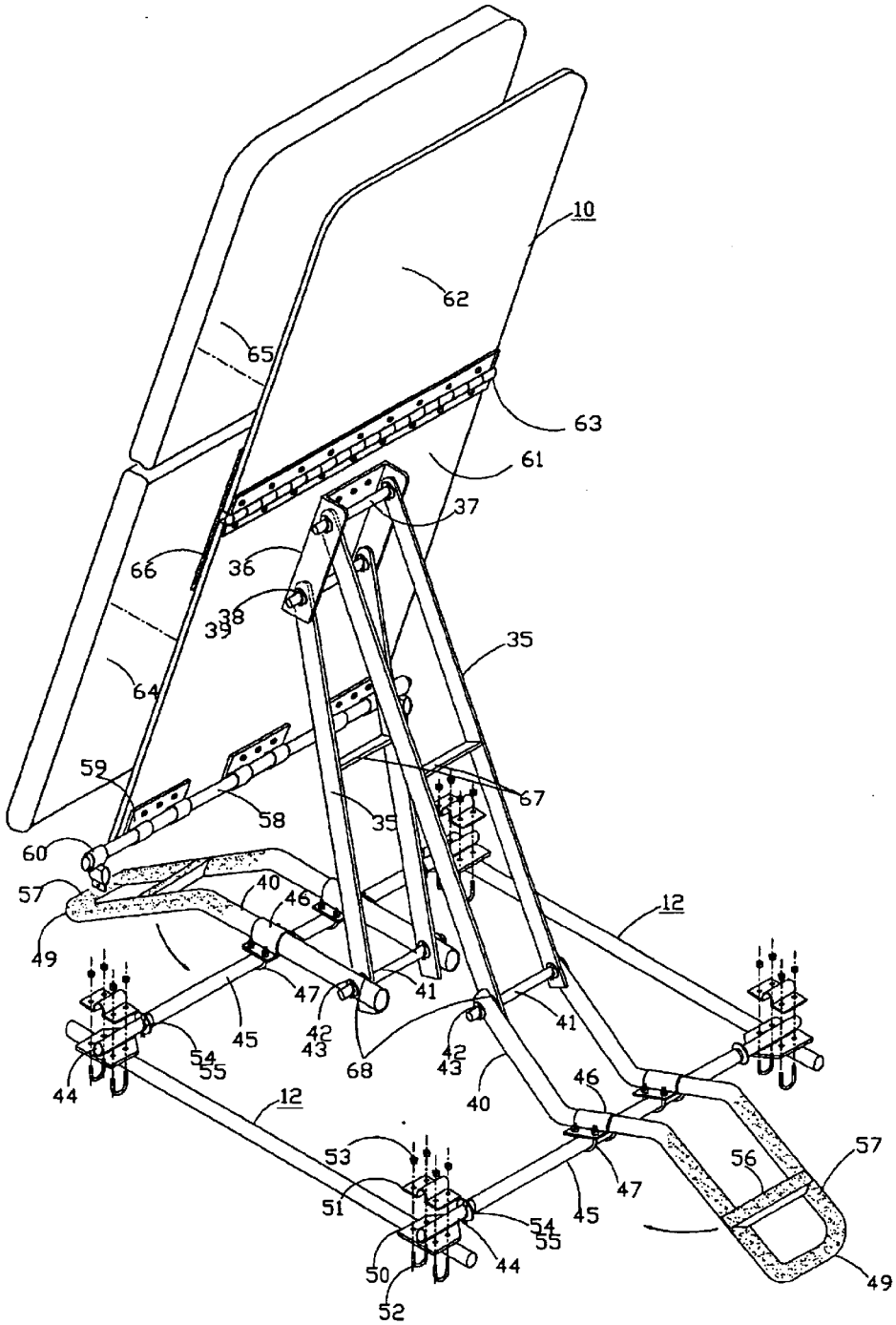
FIG. 3 is a side cross-sectional view of the apparatus of the present invention illustrating the seat in the lifting mode.

FIGS. 1 through 3 illustrates the preferred embodiment of the present invention by the numeral 10 as it is secured to the wheelchair 12 in the combination of the present invention. As illustrated in the figures, there is provided a pair of upper lift bars 35 attached to a seat bracket 36, secured with a pivot rod 37, washer 38, and pin 39, extending down to a pair of lower lift bars 40 secured with another pivot rod 41 washer 42 and pin 43, which rest on a lower frame support rod 44, rotating outer pipe 45 secured with bracket 46, U-bolts 47 and locking locks 48, lower lift bar 40 extends as foot member 49. Lower frame support rods attach to middle of 44. Front and mid-rear of wheel chair frame with flat bracket 50, rod clamp 51, U-bolts 52 and locking nuts 53. Bottom seat support strut 69 will span across rear upper frame and will be attached with clamp 70. The hinged seat and rotating outer pipe guides will be further discussed in FIG. 3. Seat lower front hinged 59 and attached to wheelchair front upper frame with pivot rod 58 and support rod bracket 60.

Figure 1A:
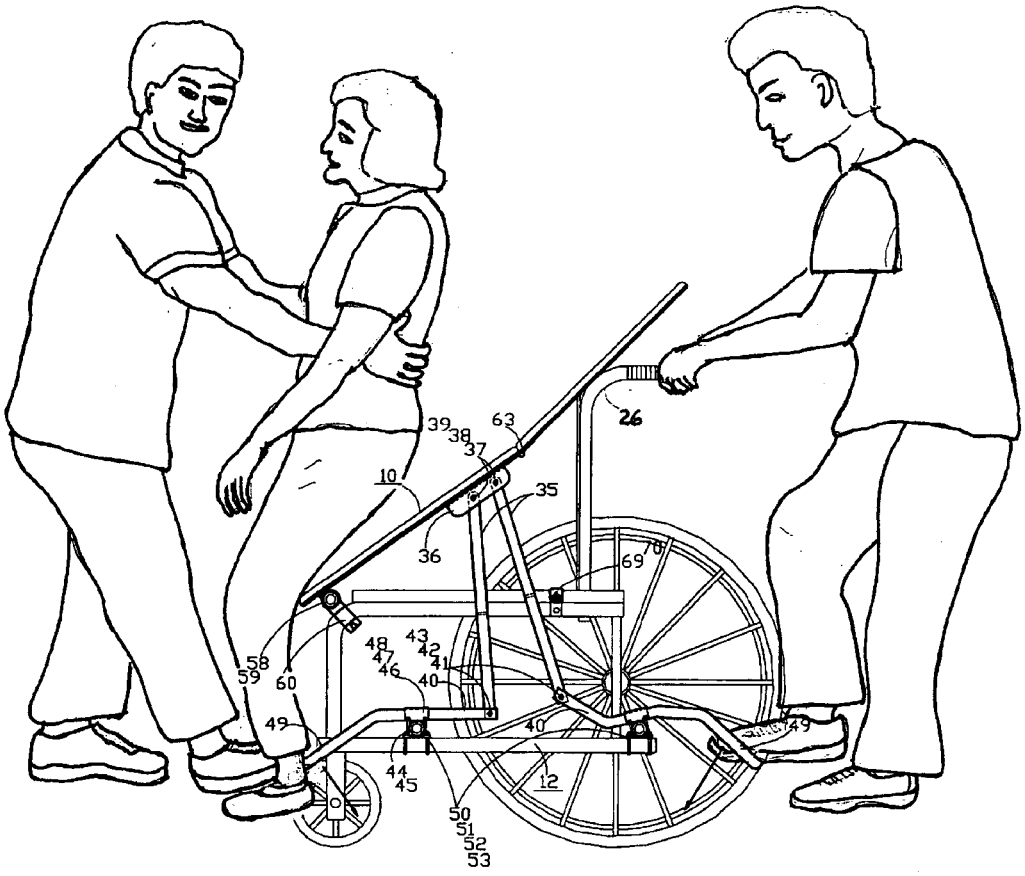
FIG. 1A is a side view of the lift mechanism illustrating the caregiver in the front assisting a person seated in the wheelchair move to a standing position also, allowing a third person to actuate the rear foot member.

FIG. 1A reference numeral elements are consistent with FIG. 1 illustrating the principal object of the present invention with caregivers to maneuver the seat from a sitting position to a second position, moving the person in the chair to a standing position. A third person actuates the rear foot member.

FIG. 2 is a cross-sectional side view of the present invention identical wherein with same reference numerals and FIG. 1 and denote same elements as FIG. 1 with the exception of the seat in the sitting position.

FIG. 3, reference is made to the wheelchair lift apparatus as it would appear, in detail, without the wheelchair, but only the wheel chair frame member 12 used to support lower frame rods 44, attached with flat bracket 50, rod clamp 51 & locking nuts 53. Lower frame rods 44 used as a leverage pivot with outer rotating pipe sleeve 45 support lower lift arm 40 extending as also part of the foot member 49. Lower lift arm 40 secured to rotating pipe sleeve 45 with arm brackets 46 & U bolts 47. Rotating pipe sleeves 45 maintain position on frame rod 44 with bushing 54 & pin 55 at pipe ends through frame rod 44. Foot members 49 are strengthened with cross strut 56 and coated with slip resistant coating 57 to assure footing. Lower lift arms 40 attach to upper lift arms 35 with pivot rod 41 and secure together with washer 42 & pin 43, ease of pivot between upper & lower lift arms 35, 40 with Teflon bushing 68. Upper lift arms 35 are strengthened with joining crossbar 67 at mid section. Top of upper lift bar 35 attaches to seat bracket 36 with pivot rod 37 and secured with washer 38 & pin 39 through pivot rod 37. Seat bracket 36 attaches to rear bottom of hard plastic seat 61, front bottom of hard plastic seat 61, attached front seat hinges 59 rotate on upper frame rod 58 secured to wheelchair upper frame with upper rod clamp 60. Seat 61 and back portion 62 are joined and partially hinged with piano hinge 63 on the backside and joined with strong fabric 66 on the front junction. Seat back cushions 64, 65 attach to seat and back portion 61, 62. Bottom seat support strut 69 will span across rear upper frame and will be attached with clamp 70.

Again, it is foreseen that this invention can be retrofitted to any existing wheelchair and could accommodate any existing wheelchair that is constructed in a similar manner as is seen in the drawings and described in the specification. Also, this invention could be adapted to be included as part of any newly constructed wheelchair and could operate in the same fashion in either manner. It has been shown that the downward force that must be placed on either of the foot member 49 whether it be in the rear of the chair or the front of the chair is quite minimal in order to have the leverage lift to move the person from the seated position to a substantially standing position. It is through minimal effort which makes it quite effective for the invention to operate with even quite a large person seated in the chair so that they are easily assisted out of the chair during use.

Of course, if a person who is invalid or weak wants to return to the chair, it is foreseen that the seat could be placed in the seated position and the person could simply lean back against the seat while pressure is being placed on the foot actuated member 49, and the person could simply let the foot actuated member rise very slowly and move the seat from the position as seen in FIG. 1 to the seated position. This of course, would allow a large or weak person to move quite comfortably into the chair without fear of falling into the seat and perhaps injuring oneself or being banged up against the seat as the person falls therein.

The foregoing embodiments are presented by way of example only; the scope of the present invention is to be limited only by the following claims.

What is claimed is:

1. An apparatus, adaptable to a wheelchair, for assisting a person seated in the wheelchair to move to a standing position, the apparatus comprising:

a. a seat having a seat portion hinged to a back portion, the seat portion having a front end and an underside, the front end being hingedly attachable to a wheelchair;

b. at least one lift bar having an upper end and a lower end, the upper end being pivotally attached to the underside of the seat portion;

c. at least one foot actuated member having a first end pivotally attached to the lower end of a lift bar, a middle section pivotally attachable to the wheelchair, and a second end suitably disposed for engagement by a foot of a person standing adjacent to the wheelchair, whereby a person depressing said second end of the foot actuated member causes the first end of the foot actuated member to rise, pivoting about its middle section attached to the wheelchair, thereby raising the lift bar and the attached seat portion from a sitting position to a substantially flat position so that a person sitting in the seat is likewise lifted from a seated position to a partially standing position.

2. The apparatus in claim 1, wherein the number of foot actuated members is two, the first of which is attachable such that its second end is disposed toward the front of the wheelchair, and the second of which is attachable such that its second end is disposed toward the rear of the wheelchair, whereby a person standing adjacent to the front of the wheelchair can engage the first foot actuated member, and a person standing adjacent to the rear of the wheelchair can engage the second foot actuated member.

3. The apparatus in claim 1, wherein the foot actuated member is substantially U-shaped, having the U-shaped end as its second end being of suitable width to be engaged by a person's foot, and having its second end comprised of the dual arms of the U, each of which is pivotally attached to the lower end of a lift bar.

4. The apparatus of claim 1, further comprising a slip resistant coating being applied to the second end of the foot actuated member.

5. The apparatus of claim 1, wherein the seat portion is joined to the back portion with a piano hinge.

6. The apparatus of claim 1, wherein the seat portion is joined to the back portion with a strong fabric.

7. The apparatus of claim 1, further comprising a seat cushion attached to the seat portion, and a back cushion attached to the back portion.

8. An apparatus in combination with a wheelchair, for assisting a person seated in the wheelchair to move to a standing position, the apparatus comprising:

a. a seat having a seat portion hinged to a back portion, the seat portion having a front end and an underside, the front end being hingedly attached to the wheelchair;

b. at least one lift bar having an upper end and a lower end, the upper end being pivotally attached to the underside of the seat portion;

c. at least one foot actuated member having a first end pivotally attached to the lower end of a lift bar, a middle section pivotally attached to the wheelchair, and a second end suitably disposed for engagement by a foot of a person standing adjacent to the wheelchair, whereby a person depressing said second end of the foot actuated member causes the first end of the foot actuated member to rise, pivoting about its middle section attached to the wheelchair, thereby raising the lift bar and the attached seat portion from a sitting position to a substantially flat position so that a person sitting in the seat is likewise lifted from a seated position to a partially standing position.

9. The apparatus of claim 8, wherein the number of foot actuated members is two, the first of which is attached such that its second end is disposed toward the front of the wheelchair, and the second of which is attached such that its second end is disposed toward the rear of the wheelchair, whereby a person standing adjacent to the front of the wheelchair can engage the first foot actuated member, and a person standing adjacent to the rear of the wheelchair can engage the second foot actuated member.

10. The apparatus in claim 8, wherein the foot actuated member is substantially U-shaped, having the U-shaped end as its second end being of suitable width to be engaged by a person's foot, and having its second end comprised of the dual arms of the U, each of which is pivotally attached to the lower end of a lift bar.

11. The apparatus of claim 8, further comprising a slip resistant coating being applied to the second end of the foot actuated member.

12. The apparatus of claim 8, wherein the seat portion is joined to the back portion with a piano hinge.

13. The apparatus of claim 8, wherein the seat portion is joined to the back portion with a strong fabric.

14. The apparatus of claim 8, further comprising a seat cushion attached to the seat portion, and a back cushion attached to the back portion.

15. An apparatus in combination with a wheelchair, for assisting a person seated in the wheelchair to move to a standing position, the apparatus comprising:

a. a seat having a rigid seat portion hinged to a rigid back portion, the seat portion having a front end and an underside, the front end being hingedly attached to the wheelchair;

b. a seat bracket fixedly attached to the underside of the seat portion;

c. a first pair of lift bars, each having an upper end and a lower end;

d. a second pair of lift bars, each having an upper end and a lower end;

e. a first pivotal attachment means for pivotally attaching the upper end of the first pair of lift bars to the seat bracket;

f. a second pivotal attachment means for pivotally attaching the upper end of the second pair of lift bars to the seat bracket;

g. a first rigid foot actuated member having a forward portion suitably disposed and shaped for being depressed by the foot of a person standing adjacent to the front of the wheelchair, said first rigid foot actuated member having a pair of substantially parallel arms suitably spaced apart and each extending rearwardly to a position adjacent to the lower end of the first pair of lift bars;

h. a second rigid foot actuated member having a rearward portion suitably disposed and shaped for being depressed by the foot of a person standing adjacent to the rear of the wheelchair, said second rigid foot actuated member having a pair of substantially parallel arms suitably spaced apart and each extending forwardly to a position adjacent to the lower end of the second pair of lift bars;

i. a third pivotal attachment means for pivotally attaching the ends of the rearwardly extending substantially parallel arms of the first rigid foot actuated member to the lower end of the first pair of lift bars;

j. a fourth pivotal attachment means for pivotally attaching the ends of the forwardly extending substantially parallel arms of the second rigid foot actuated member to the lower end of the second pair of lift bars;

k. a fifth pivotal attachment means for pivotally attaching the first rigid foot actuated member to the wheelchair; and l. a sixth pivotal attachment means for pivotally attaching the second rigid foot actuated member to the wheelchair, whereby a person standing adjacent to the front of the wheelchair can depress the first foot actuated member, and a person standing adjacent to the rear of the wheelchair can depress the second foot actuated member, thereby raising the lift bars and the attached seat portion from a sitting position to a substantially flat position so that a person sitting in the seat is likewise lifted from a seated position to a partially standing position.

16. The apparatus of claim 15, further comprising a slip resistant coating being applied to the forward portion of the first rigid foot actuated member.

17. The apparatus of claim 15, wherein the seat portion is joined to the back portion with a piano hinge.

18. The apparatus of claim 15, wherein the seat portion is joined to the back portion with a strong fabric.

19. The apparatus of claim 15, further comprising a seat cushion attached to the seat portion, and a back cushion attached to the back portion.

* * * * *